US009162474B2

(12) United States Patent
Kondo et al.

(10) Patent No.: US 9,162,474 B2
(45) Date of Patent: Oct. 20, 2015

(54) METHOD FOR CALCULATING COMPENSATION VALUE

(71) Applicant: SEIKO EPSON CORPORATION, Tokyo (JP)

(72) Inventors: Takamitsu Kondo, Azumino (JP); Toru Takahashi, Azumino (JP); Tsuneo Kasai, Azumino (JP); Kazuyoshi Tanase, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/222,034

(22) Filed: Mar. 21, 2014

(65) Prior Publication Data

US 2014/0292870 A1 Oct. 2, 2014

(30) Foreign Application Priority Data

Mar. 29, 2013 (JP) ..... 2013-071619

(51) Int. Cl.

| | |
|---|---|
| ***B41J 29/393*** | (2006.01) |
| ***B41J 2/21*** | (2006.01) |
| ***B41J 2/175*** | (2006.01) |
| ***B41J 29/38*** | (2006.01) |

(52) U.S. Cl.

CPC ..... *B41J 2/2114* (2013.01); *B41J 2/175* (2013.01); *B41J 2/17596* (2013.01); *B41J 2/2142* (2013.01); *B41J 2/2146* (2013.01); *B41J 29/38* (2013.01); *B41J 2029/3935* (2013.01)

(58) Field of Classification Search

CPC ..... B41J 29/393; B41J 2/17596; B41J 29/38; B41J 2/175; B41J 2/2114; B41J 2/2146; B41J 2/2142; B41J 2029/3935

USPC ..... 347/9, 14, 19–21, 84, 85

See application file for complete search history.

(56) References Cited

U.S. PATENT DOCUMENTS

| | | | | |
|---|---|---|---|---|
| 5,777,636 | A * | 7/1998 | Naganuma et al. | 347/10 |
| 2007/0046715 | A1* | 3/2007 | Yamanobe et al. | 347/19 |
| 2009/0244149 | A1* | 10/2009 | Yamazaki | 347/14 |
| 2010/0039463 | A1* | 2/2010 | Van Thillo et al. | 347/9 |

FOREIGN PATENT DOCUMENTS

| | | |
|---|---|---|
| JP | 2004-338275 | 12/2004 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

A method for calculating a compensation value for use in a correction of a liquid landing position in a liquid ejection device provided with a first head for ejecting a first colored liquid and a second head for ejecting a transparent liquid includes, when forming a test pattern on a medium, forming the test pattern by feeding the first colored liquid to the second head and causing the second head to eject the first colored liquid, and obtaining a compensation value for a correction of a landing position of a liquid ejected by the second head on the basis of the test pattern formed on the medium.

8 Claims, 8 Drawing Sheets

| UNIT | FILLING WITH INK FOR TESTING | FILLING WITH INK FOR PRINTING |
|---|---|---|
| WHITE W | WHITE | CYAN |
| CYAN Cy | CYAN | — |
| MAGENTA M | MAGENTA | MAGENTA |
| BLACK K | BLACK | BLACK |
| YELLOW Y | YELLOW | — |
| CLEAR Cl | CLEAR | YELLOW |

METHOD FOR CALCULATING COMPENSATION VALUE

BACKGROUND

1. Technical Field

The present invention relates to a method for calculating a compensation value.

2. Related Art

Ink jet type printers which form images by ejecting ink have been developed. In such an ink jet type printer, in order to compensate landing position errors of ink, a series of measures of performing printing of a test pattern, reading in this test pattern by using a scanner, detecting landing errors, and performing control of ejection timing points on the basis of the detected landing errors have been implemented.

In JP-A-2004-338275, there is disclosed a method of performing a test print, reading in an image of this test print and correcting landing positions of ink on the basis of the read-in image.

Such ink jet type printers include ones which are of a type provided with a function of ejecting a clear ink. In this case, however, it is difficult for a scanner to exactly read in landing positions of the clear ink because the clear ink is transparent. For this reason, just an application of such a landing position correction method described above has been insufficient to enable correction of landing position misalignments with respect to the clear ink. Accordingly, even in the case where a transparent ink is ejected, a method of appropriately correcting landing positions thereof is desired.

SUMMARY

An advantage of some aspects of the invention is to provide a method of, even in the case where a transparent liquid is ejected, correcting landing positions thereof appropriately.

According to an aspect of the invention, there is provided a method for calculating a compensation value for use in a correction of a liquid landing position in a liquid ejection device provided with a first head for ejecting a first colored liquid and a second head for ejecting a transparent liquid. The method includes, when forming a test pattern on a medium, forming the test pattern by feeding the first colored liquid to the second head and causing the second head to eject the first colored liquid, and obtaining a compensation value for a correction of a landing position of a liquid ejected by the second head on the basis of the test pattern formed on the medium.

Other aspects of the invention will become apparent from description of this specification and accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
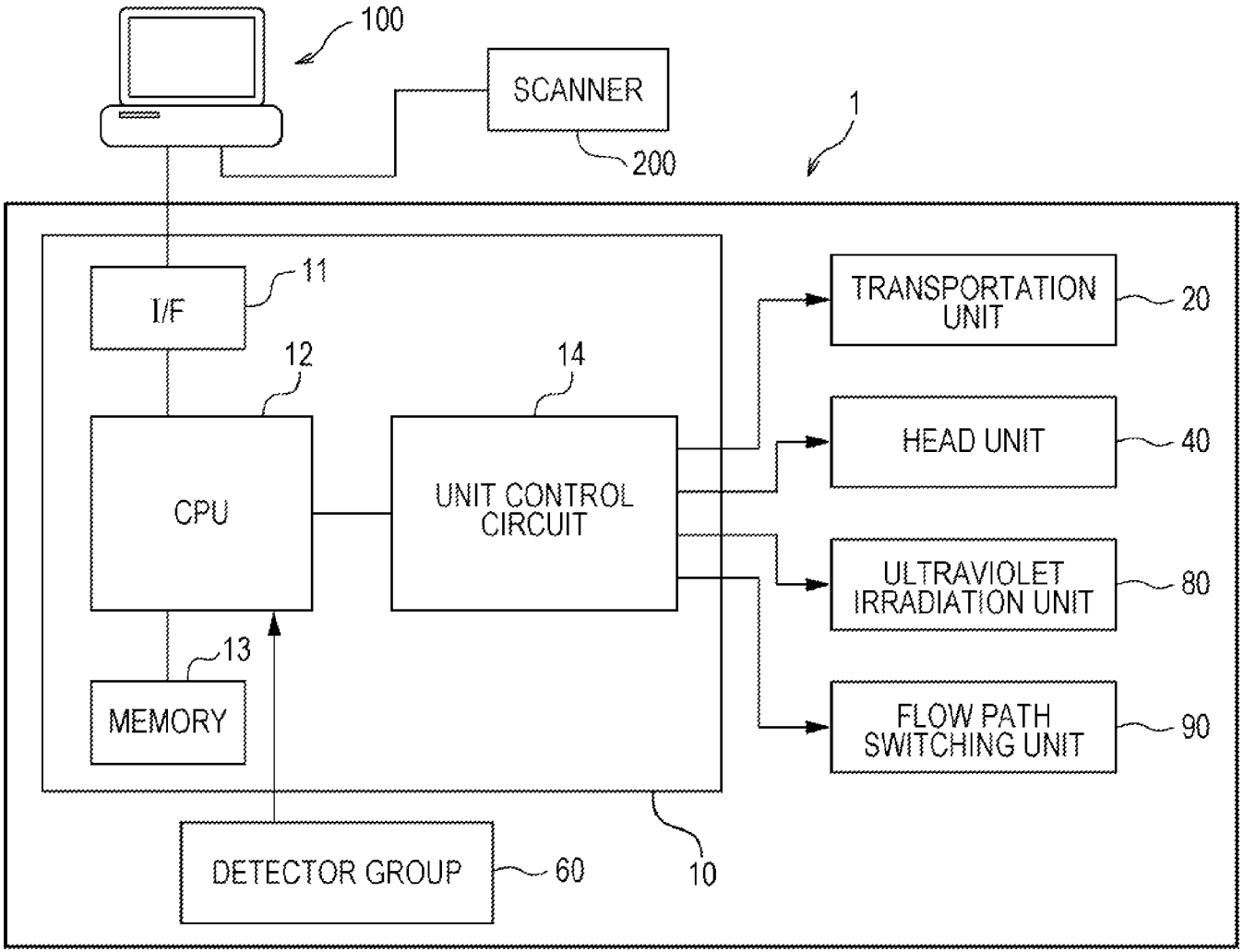
FIG. 1 is a block diagram illustrating the whole configuration of a printer.

At least the following matters will become apparent from description of this specification and the accompanying drawings. That is, a method for calculating a compensation value for use in a correction of a liquid landing position in a liquid ejection device provided with a first head for ejecting a colored liquid and a second head for ejecting a transparent liquid includes, when forming a test pattern on a medium, forming the test pattern by feeding the colored liquid to the second head and causing the second head to eject the colored liquid, and obtaining a compensation value for a correction of a landing position of a liquid ejected by the second head on the basis of the test pattern formed on the medium.

Through this method, when a test pattern is formed, a colored liquid is fed to the second head for ejecting a transparent liquid, and thus, the second head can form the test pattern by using the colored liquid. Further, on the basis of the test pattern having been formed by using the colored liquid, it becomes possible to obtain a compensation value for a correction of a landing position of a liquid ejected by the second head. In this way, a compensation value for the second head which ejects a transparent liquid can be obtained, and thus, it becomes possible to appropriately correct a landing position of the transparent liquid ejected by the second head.

In the aforementioned method for calculating a compensation value, preferably, the liquid ejection device is provided with a third head for ejecting a white liquid, and when the test pattern is formed, the test pattern is formed by feeding a second colored liquid to the third head and causing the third head to eject the second colored liquid and a compensation value for a correction of a landing position of a liquid ejected by the third head is obtained on the basis of the test pattern formed on the medium.

Through this method, when a test pattern is formed, a colored liquid is fed to the third head for ejecting a white liquid, and thus, the third head can form the test pattern by using the colored liquid. Further, on the basis of the test pattern having been formed by using the colored liquid, it becomes possible to obtain a compensation value for a correction of a landing position of a liquid ejected by the third head. In this way, a compensation value for the third head which ejects a white liquid can be obtained, and thus, it becomes possible to appropriately correct a landing position of the white liquid ejected by the third head.

Further, preferably, when the test patter is formed, a color of the first colored liquid fed to the second head is different from a color of the second colored liquid fed to the third head.

In this way, when a test pattern is formed, the second head can be fed with a color the same as a color of a head adjacent to the second head, and the third head can be fed with a color the same as a color of a head adjacent to the third head. For example, in the case where a head adjacent to the second head ejects a yellow liquid, the second head can be fed with the yellow liquid, and simultaneously therewith, in the case where a head adjacent to the third head ejects a cyan liquid, the third head can be fed with the cyan liquid.

Further, preferably, the liquid ejection device is provided with a first container for storing therein the first colored liquid and a first flow path for feeding the first colored liquid to the second head from the first container, as well as a second container for storing therein the transparent liquid and a second flow path for feeding the transparent liquid to the second head from the second container, and, when the first colored liquid is fed to the second head, the first colored liquid is fed to the second head through the first flow path, and feeding of the transparent liquid to the second head through the second flow path is brought to a stop.

In this way, it becomes possible to feed a colored liquid to the second head by controlling the feedings of liquids through the first and second flow paths to the second head.

Further, preferably, the liquid ejection device is provided with a fourth head for ejecting a colored liquid whose color is different from a color of the first colored liquid, and when the test pattern is formed, the fourth head is caused to form a first pattern, the second head is caused to form a second pattern, and a compensation value for a correction of a landing position of a liquid ejected by the second head is obtained on the basis of the first pattern and the second pattern.

In this way, it becomes possible to obtain a compensation value for a correction of a landing position of a liquid ejected by the second head in a relation between the first pattern formed by the fourth head and the second pattern formed by the second head.

Further, preferably, the liquid ejection device is provided with a plurality of the second heads; the plurality of second heads are arranged such that a nozzle row of any one of the second heads extends so as to overlap at least part of a nozzle row of at least one of the other ones of the second heads in a direction intersecting with a direction in which the medium is transported; and a compensation value for a correction of a landing position of a liquid ejected by any one of the second heads is equivalent to a compensation value which is obtained such that, for any two ones of the second heads, a landing position of a liquid ejected by one of the two ones of the second heads is made a baseline, and on the basis of the baseline, a compensation value for a correction of a landing position of a liquid ejected by the other one of the two ones of the second heads is obtained.

In this way, it becomes possible to, for a pair of the second heads which are adjacent to each other, make one of the pair of the second heads a baseline and, on the basis of this baseline, obtain a compensation value for a correction of a landing position of a liquid ejected by the other one of the pair of the second heads.

Further, preferably, the test pattern is read in by an image reader, and a compensation value for a correction of a liquid ejected by the second head is obtained on the basis of the image data which is read in by the image reader.

In this way, it becomes possible to obtain a compensation value on the basis of an image of the test pattern, having been acquired by using the image reader.

Preferably, the compensation value corresponds to a compensation value for a correction of a formation position of a dot which, on the medium, needs to be formed at a position coinciding with a position of a target pixel.

In this way, it becomes possible to appropriately correct a landing position of a liquid by shifting the formation position of a dot which needs to be formed at a position coinciding with a position of a target pixel.

Embodiments

Figure 2:
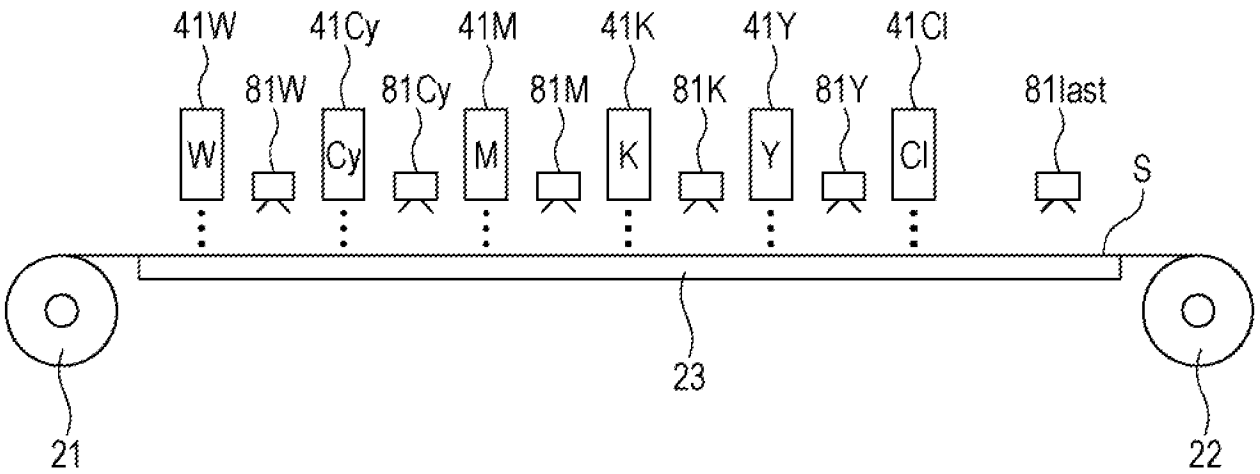
FIG. 2 is a schematic side view of a printer.

FIG. 1 is a block diagram illustrating the whole configuration of a printer 1. FIG. 2 is a schematic side view of the printer 1. When having received print data such as a print job from a computer 100, the printer 1 performs control of individual units (a transportation unit 20, a head unit 40, an ultraviolet irradiation unit 80 and a flow path switching unit 90) through a controller 10, and thereby performs printing of images on paper S. Further, a detector group 60 monitors and detects conditions inside the printer 1, and the controller 10 performs control of the individual units on the basis of the results of the detections conducted by the detector group 60. In addition, a scanner 200 (an image reader) is also connected to the computer 100.

The controller 10 is a control unit for performing control of the printer 1. An interface portion 11 is a component for transmitting and receiving data between the printer 1 and the computer 100 which is an external device. A CPU 12 is an arithmetic processing unit for performing control of the entire printer 1. A memory 13 is a component for securing a program storage area, a work area and the like for the CPU 12. The CPU 12 performs control of the individual units through the unit control unit 14 in accordance with the programs stored in the memory 13.

The transportation unit 20 includes an unreeling roll 21, a reeling roll 22 and a platen 23. The unreeling roll 21 is a component for feeding a medium, such as the paper S. The unreeling roll 21 is coupled to a motor (not illustrated), and the rotation of the motor is controlled by the controller 10. Further, the reeling roll 22 is a component for reeling and collecting a medium, such as the paper S. The reeling roll 22 is also coupled to a motor (not illustrated), and the rotation of the motor is controlled by the controller 10. Further, the transportation unit 20 is provided, between the unreeling roll 21 and the reeling roll 22, with the platen 23 for supporting the paper S. In this way, images can be formed by ejecting inks onto the paper S which is placed on the platen 23 while causing the platen 23 to support the paper S which is fed from the unreeling roll 21.

The head unit 40 includes a white ink head unit 41W, a cyan ink head unit 41Cy, a magenta ink head unit 41M, a black ink head unit 41K, a yellow ink head unit 41Y and a clear ink head unit 41Cl.

FIG. 2 illustrates a state where the white ink head unit 41W, the cyan ink head unit 41Cy, the magenta ink unit head 41M, the black ink head unit 41K, the yellow ink head unit 41Y and the clear ink head unit 41Cl are arranged from the upstream side in a direction in which the paper S is transported.

Each of these head units 41 which is associated with a corresponding one of the ink colors is a unit for ejecting ink droplets onto the paper S, and includes a plurality of heads. Each of these heads is provided on its bottom face with a plurality of nozzles through each of which an ink is ejected. This plurality of heads arranged in a zigzag form in each of the head units 41 which is associated with a corresponding one of the ink colors enables formation of an image whose size in the width direction of the paper S is large. Each of the nozzles is provided with a pressure chamber (not illustrated) in which an ink is contained, as well as a driving element (a piezoelectric element) for causing the ink to be ejected from the pressure chamber by causing a variation of the volume of the pressure chamber. Further, in this embodiment, an ink ejected from each of the head units 41 which is associated with a corresponding one of the ink colors is an ultraviolet hardening type ink (a UV ink).

The ultraviolet irradiation unit 80 includes a plurality of ultraviolet irradiation devices 81W, 81Cy, 81M, 81K and 81Y. These ultraviolet irradiation units are units each for performing temporal hardening of an ink which is already landed on the paper S. Further, an ultraviolet irradiation device 81last is provided at a most downstream position. The ultraviolet irradiation unit 81last is a unit for performing full hardening of an ink which is already landed on the paper S. In addition, the temporal hardening means a process of hardening the surface of an ink landed on the paper S to a degree that does not cause the ink to be mixed with an ink whose color is different from that of the ink; while the full hardening means a process of hardening an ink landed on the paper S to a degree that causes the hardening to reach the inside of the ink.

Further, the printer 1 includes the flow path switching unit 90. The flow path switching unit 90, a configuration thereof being described below, is a unit for switching a kind of ink to be fed to clear ink heads 43Cl and white ink heads 43W for each of the clear head Cl and the white head W.

Figure 3:
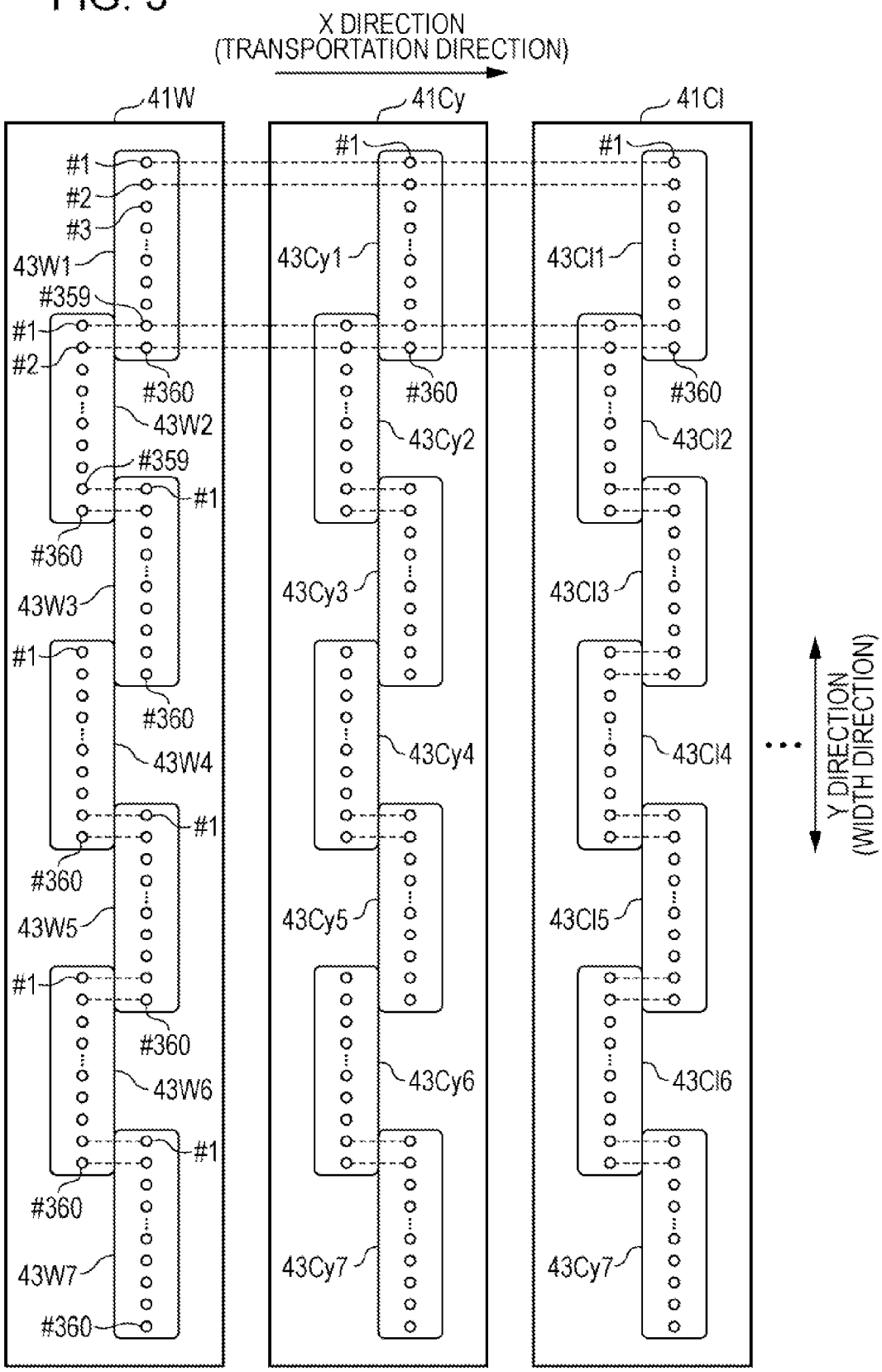
FIG. 3 is an explanatory diagram of an arrangement of heads in each of head units which is associated with a corresponding one of ink colors.

FIG. 3 is an explanatory diagram of an arrangement of heads 43 in each of the head units 41 which is associated with a corresponding one of the ink colors. In FIG. 3, there are illustrated the white ink head unit 41 W, the cyan ink head unit 41Cy and the clear ink head unit 41Cl among the head units 41 for all the ink colors. In FIG. 3, each of the head units 41 is viewed from its upper direction. Although, actually, the nozzles are hard to be viewed because they are located behind other members, here, for the sake of convenience of description, the nozzles are illustrated such that they become transparently viewable.

Each of the head units 41 includes seven heads 43, and a way of arranging the heads 43 is common to each of the head units 41. Further, the positions of the nozzles are designed such that, in each of the head units, the nozzles of one of the heads extend so as to overlap the nozzles of another one of the heads in the width direction of the paper S (a Y direction). Further, each of the heads 43 includes nozzle edges #1 to #360, and a nozzle pitch thereof is 360 dpi. These heads 43 are arranged in a so-called zigzag form, and further, are arranged such that, in the width direction of the paper S, a nozzle #359 and a nozzle #360 of one of the heads 43 overlap a nozzle #1 and a nozzle #2 of another one of the heads 43 which is adjacent to the one of the head 43, respectively.

In addition, in this embodiment, when all the head units are collectively referred to, a sign "40" is appended to "head unit", and when a head unit corresponding to a specific ink color is referred to, a sign "41" and a sign indicating an ink color corresponding to the specific ink color are appended to "head unit". Further, with respect to the seven heads included in each of the head units 41, when correctively referred to as just heads, a sign "43" is appended to "heads", and further, when heads corresponding to a specific ink color is referred to, a sign indicating an ink color corresponding to the specific ink color is appended to the sign "43". Further, with respect to a certain one of the heads included in each of the head units 41, when a head number of the certain head is specified, the certain head is denoted such that, additionally, its head number is appended to the sign indicating its ink color. Further, in this embodiment, there are some cases where heads included in a certain head unit 41 are referred to by being specified by an ink color of the heads, such as "black ink heads 43K".

As described above, the printer 1 is configured so as to eject a plurality of inks, and there occur some cases where, because of errors, such as an error with respect to an attachment position of a certain one of the heads 43, dots are formed at positions on the paper S which are out of alignment from positions where the dots are originally to be landed. In the case where such misalignments occur among landed dots having been printed in a colored ink, amounts of the misalignments can be recognized with eyes, and can be also recognized by using an image of the landed dots, taken by an image reader, such as a scanner. In contrast, in the case where such misalignments occur among landed dots having been printed in a clear ink, amounts of the misalignments are hard to be recognized with eyes because of the feature of the clear ink, and even when an image of the landed dots is taken by an image reader, such as a scanner, it is difficult to recognize the color of the landed dots. Accordingly, it is desired to realize a configuration which enables correction of landing positions of such a clear ink by appropriately recognizing the landing positions thereof with respect to heads each ejecting the clear ink. A configuration provided in each of embodiments described below enables correction of landing positions of the clear ink by appropriately recognizing the landing positions thereof with respect to heads each ejecting the clear ink.

Figures 4, 5:
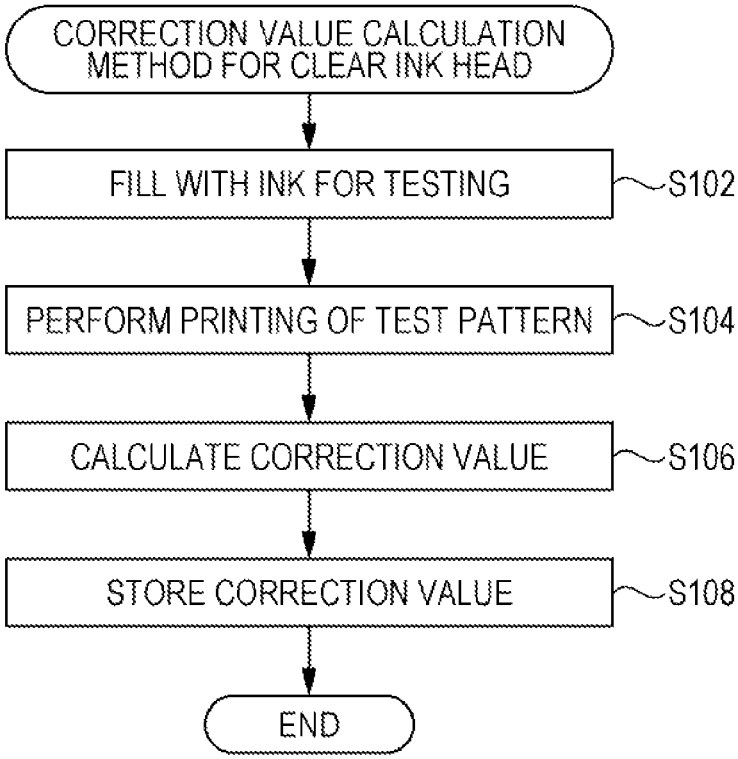
FIG. 4 is a flowchart illustrating a compensation value calculation method for a clear head.
FIG. 5 is an explanatory diagram of inks with each of which a corresponding one of head units is filled.

FIG. 4 is a flowchart illustrating a compensation value calculation method for a clear head. Hereinafter, a compensation value calculation method for a clear head will be described with reference to this flowchart. In this compensation value calculation method, first, filling relevant head units with their respective corresponding inks for forming a test pattern is performed (S102).

FIG. 5 is an explanatory diagram of inks with each of which a corresponding one of head units is filled. In FIG. 5, there are illustrated inks with which filling is performed at the time of printing actual images (i.e., inks for use in filling with inks for printing), and inks with which filling is performed at the time of printing a test pattern (i.e., inks for use in filling with inks for testing).

In the filling with inks for printing, the heads 43 of each of the head units 41 are filled with a corresponding one of the inks for use in printing. Thus, for example, heads 43W of the white ink head unit 41W are filled with a white ink. Further, heads 43Cl of the clear ink head unit 41Cl are filled with a clear ink.

Meanwhile, in the filling with inks for testing, the heads 43 of each of relevant head units 41 are filled with a corresponding one of inks for use in forming a test pattern. In this embodiment, when the test pattern is formed, each of white ink heads 43W ejects a cyan ink Cy. Thus, when the test pattern is formed, each of the white ink heads 43W is filled with the cyan ink Cy. Further, when the test pattern is formed, each of clear ink heads 43Cl ejects a yellow ink Y. Thus, when the test pattern is formed, each of the clear ink heads 43Cl is filled with the yellow ink Y.

Figure 6A:
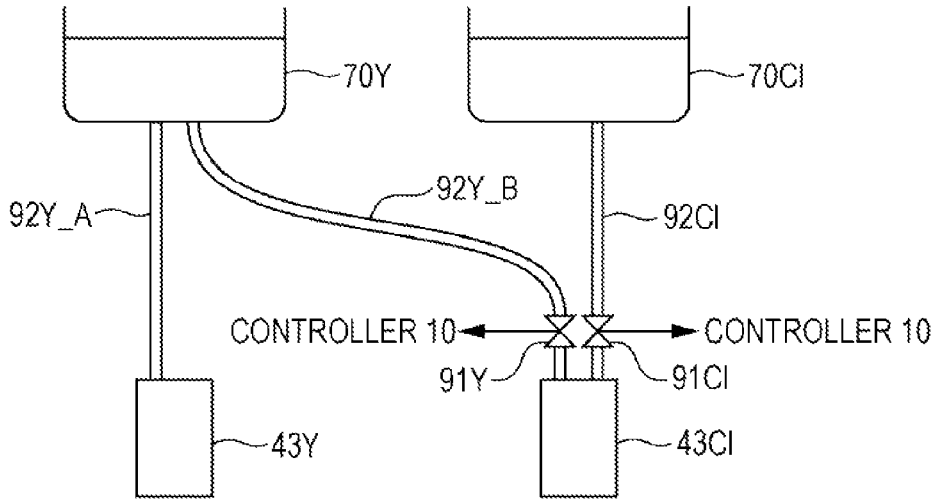
FIG. 6A is a first explanatory diagram of ink feeding paths.
Figure 6B:
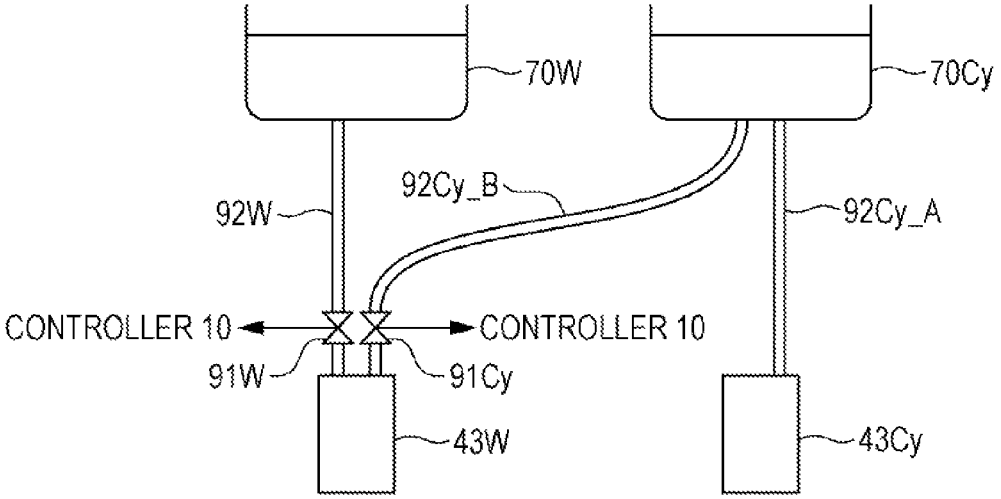
FIG. 6B is a second explanatory diagram of ink feeding paths.

FIG. 6A is a first explanatory diagram of ink feeding paths, and FIG. 6B is a second explanatory diagram of ink feeding paths. FIG. 6A illustrates feeding paths for inks fed to heads included in a clear ink head unit. FIG. 6B illustrates feeding paths for inks fed to heads included in a white ink head unit. In addition, a mechanism illustrated in FIG. 6A is approximately the same as a mechanism illustrated in FIG. 6B except that only a difference exists between ink colors used therefor, and thus, operation of the mechanism illustrated in FIG. 6A will be described and operation of the mechanism illustrated in FIG. 6B will be omitted.

FIG. 6A illustrates an yellow ink tank 70Y in which the yellow ink Y is stored; a clear ink tank 70Cl in which a clear ink Cl is stored; yellow ink heads 43Y; and the clear ink heads 43Cl.

A first yellow ink feeding tube 92Y_A for feeding the yellow ink Y from the yellow ink tank 70Y to the yellow ink heads 43Y is attached to an upper portion of the yellow ink heads 43Y. A clear ink feeding tube 92Cl (corresponding to the second flow path) for feeding the clear ink Cl from the clear ink tank 70Cl to the clear ink heads 43Cl is attached to an upper portion of the clear ink heads 43Cl. Moreover, a second yellow ink feeding tube 92Y_B (corresponding to the first flow path) for feeding the yellow ink Y from the yellow ink tank 70Y to the clear ink heads 43Cl is attached to another upper portion of the clear ink heads 43Cl.

The clear ink feeding tube 92Cl is provided with an electromagnetic valve 91Cl in the mid-flow of the clear ink feeding tube 92Cl itself, and the second yellow ink feeding tube 92Y_B is provided with an electromagnetic valve 91Y in the mid-flow of the second yellow ink feeding tube 92Y_B itself. With respect to these electromagnetic valves 91Cl and 91Y, their respective opening and closing operations are controlled in accordance with signals from the controller 10.

Further, during operation of the foregoing filling with inks for printing, the electromagnetic valve 91Y is controlled to a closed state; while the electromagnetic valve 91Cl is controlled to an open state, so that the clear ink heads 43Cl are fed with the clear ink Cl. Meanwhile, during operation of the foregoing filling with inks for testing, the electromagnetic valve 91Y is controlled to an open state; while the electromagnetic valve 91Cl is controlled to a closed state, so that the clear ink heads 43Cl are fed with the yellow ink Y.

In this embodiment, when a test pattern is formed, the yellow ink Y is fed to the clear ink heads 43Cl from the yellow ink tank 70Y but, alternatively, an ink tank for test-pattern printing in which a colored ink is contained may be provided in advance, and this colored ink may be fed from this ink tank. Moreover, when a test pattern is formed, the cyan ink Cy is fed to the white ink heads 43W from the cyan ink tank 70Cy but, alternatively, an ink tank for test-pattern printing in which a colored ink is contained may be provided in advance, and this colored ink may be fed from this ink tank.

In addition, when switching of these inks is performed, it is desirable to perform operation of ejecting all inks remaining inside the heads (for example, flushing operation or the like). In this way, when the filling with inks for testing is performed, it is possible to feed the yellow ink Y to the clear ink heads 43Cl and feed the cyan ink Cy to the white ink heads 43W.

Next, printing of a test pattern is performed (S104).

Figure 7:
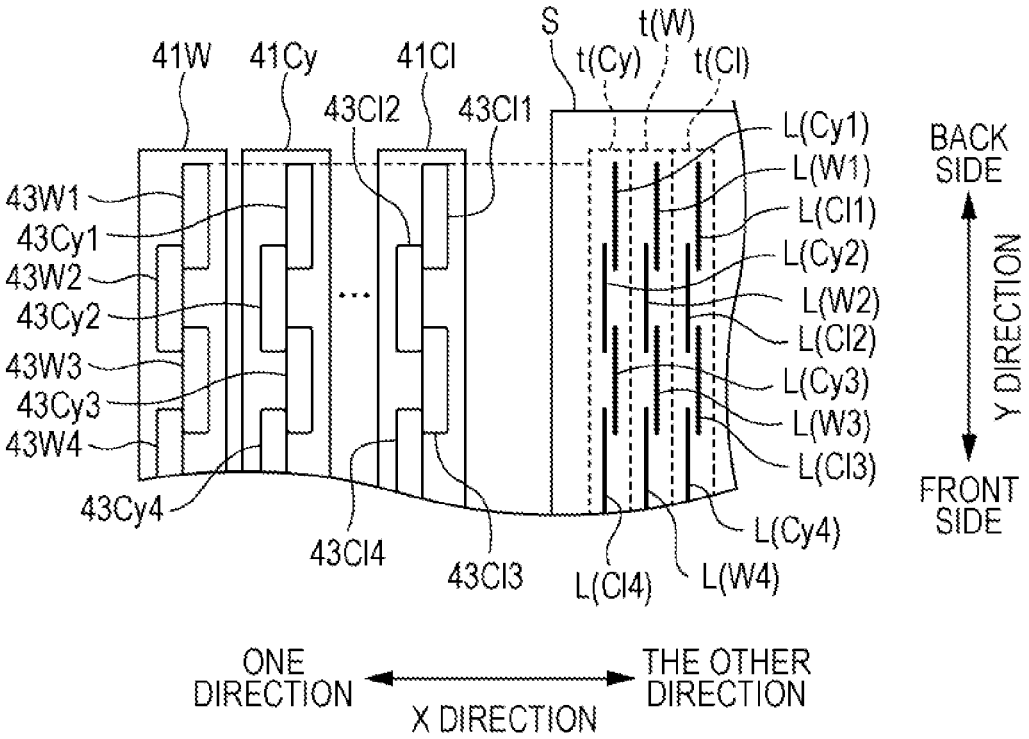
FIG. 7 is a schematic explanatory diagram of a test pattern.

FIG. 7 is a schematic explanatory diagram of a test pattern. In FIG. 7, the white ink head unit 41W, the cyan ink head unit 41Cy and the clear ink head unit 41Cl are partially illustrated. Further, a test pattern having been formed by these head units is illustrated.

This test pattern is composed of a test pattern t (Cy) formed by the cyan ink head unit 41Cy; a test pattern t (W) formed by the white ink head unit 41W; and a test pattern t (Cl) formed by the clear ink head unit 41Cl. Each of these three kinds of test patterns includes a plurality of ruled lines L. Further, each of the ruled lines L is denoted by two signs appended to a sign "L", a first one being a sign indicating an ink color of one of the head units which includes a head having formed the relevant ruled line L, a second one being a sign indicating a serial number of the head within the one of the head units. For example, "L (Cy1)" indicates a ruled line having been formed by a head 43Cy1 which is a 1st one of cyan ink heads 43Cy. Further, for example, "L (Cl3)" indicates a ruled line having been formed by a head 43Cl3 which is a 3rd one of clear ink heads 43Cl. As shown in FIG. 7, ruled lines of every two adjacent heads are formed so as to be distanced from each other in the transportation direction.

Figure 8:
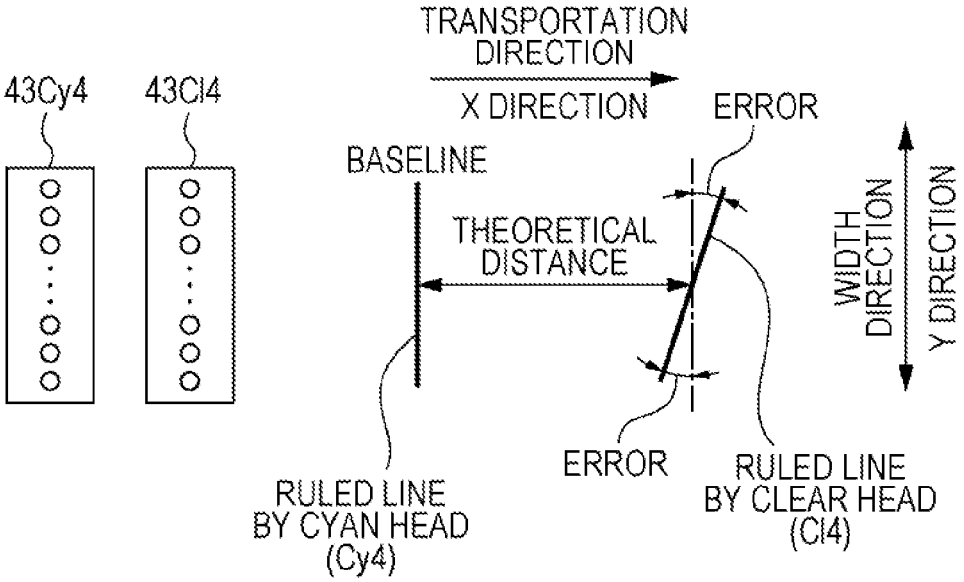
FIG. 8 is a first explanatory diagram of a test pattern.

FIG. 8 is a first explanatory diagram of a test pattern. In FIG. 8, there are illustrated a cyan ink head 43Cy4 and a clear ink head 43Cl4. In FIG. 8, among a plurality of ruled lines included in a test pattern, a ruled line L (Cy4) having been printed by the illustrated cyan ink head 43Cy4 and a ruled line L (Cl4) having been printed by the illustrated clear ink head 43Cl4 are illustrated. In addition, at this time, this ruled line L (Cl4) becomes visible because an ink ejected from the clear ink head 43Cl4 is the yellow ink Y.

Further, in FIG. 8, a theoretical position indication line corresponding to the ruled line L (Cl4) having been printed by the clear ink head 43Cl4, the theoretical position indication line being distanced from the ruled line L (Cy4) having been printed by the cyan ink head 43Cy4 by a theoretical distance, is denoted by an alternate long and short dash line. Originally, the ruled line L (Cl4) is a line to be formed on the theoretical position indication line. Thus, an amount of a misalignment of the ruled line L (Cl4) relative the theoretical position indication line corresponds to an error.

Here, an amount of a misalignment of the ruled line L (Cl4) having been printed by the clear ink head 43Cl4 is obtained by making the ruled line L (Cy4) having been printed by the cyan ink head 43Cy4 a baseline, and on the basis of this obtained amount of a misalignment, a compensation value by which landing positions of dots formed by the clear ink head 43Cl4 are to be corrected is obtained.

Next, compensation value calculation processing is performed (S106). In the correction of dot landing positions in this embodiment, shifting of pixel data, which will be described below, is performed, and the compensation value is a value indicating the number of pixels equivalent to a shift amount by which the pixel data is to be shifted.

The foregoing printed test pattern (FIG. 7) is read in by the scanner 200 prior to beginning of the compensation value calculation processing (S106). Further, on the basis an image generated from the read-in test pattern, the positions of ruled lines included in the test pattern are identified. In addition, the identification of the positions of the ruled lines included in the test pattern may be performed by not using the scanner 200 but simply measuring the printed ruled lines.

Figure 9:
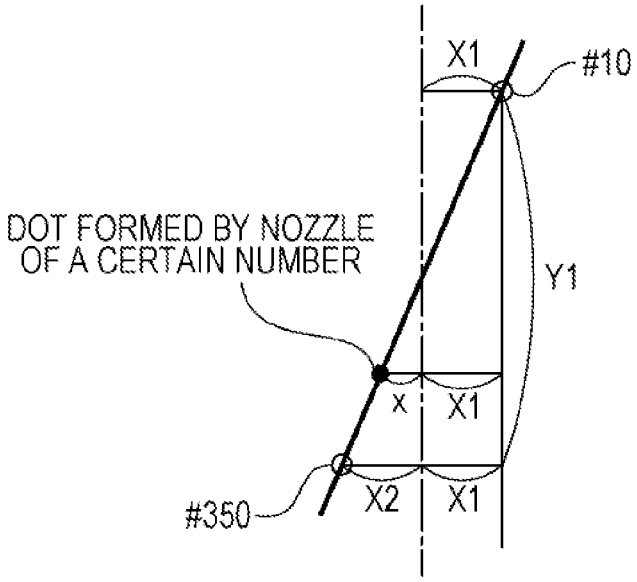
FIG. 9 is an explanatory diagram of an error of a ruled line printed by a clear head.

FIG. 9 is an explanatory diagram of an error of a ruled line printed by a clear head. In FIG. 9, a theoretical position indication line handled as a baseline is denoted by an alternate long and short dash line. Further, in FIG. 9, the ruled line L (Cl4) having been printed by the clear ink head 43Cl4 is illustrated.

A ruled line is printed by ejecting an ink through each of all nozzles of a head. That is, a ruled line is printed by ejecting an ink through each of nozzles #1 to #360 of a head. A distance from the nozzle #1 up to the nozzle #360 is known from a design specification. Thus, from a relation with the distance between these two nozzles, it is possible to recognize by which one of the nozzles each of dots existing on the ruled line has been formed.

Here, as shown in FIG. 9, for example, the positions of dots having been formed by the nozzle #10 and the nozzle #350 are identified. At this time, a method for obtaining a compensation value for a correction of the position of a dot formed by a nozzle of a certain nozzle number is considered. As described above, in this embodiment, it is supposed that the compensation value is a shift amount by which pixel data is to be shifted. Here, this pixel data is data for specifying, for each of pixels on a medium, which size of a dot is to be formed and which kind of an ink to be used. A method for shifting the pixel data will be described below.

In FIG. 9, a misalignment value x of a dot having been formed by a nozzle of a certain nozzle number is illustrated. In FIG. 9, with respect to this misalignment value x, a ratio relationship described below is satisfied. In addition, in FIG. 9, X1, X2 and Y1 are values which can be measured on the basis of image data having been read in by the scanner 200.

$$(X1+X2):Y1=(x+X1):(\text{target nozzle number}/340)\times Y1$$

The misalignment amount x can be obtained from this relationship.

In this embodiment, a pixel pitch in the transportation direction is 360 dpi. Thus, the size of a pixel becomes approximately 0.071 millimeters. Accordingly, a compensation value (the number of pixels to be shifted) can be obtained by x/0.071. Such a compensation value can be obtained for each of all the nozzles in such a way as described above.

Figure 10:
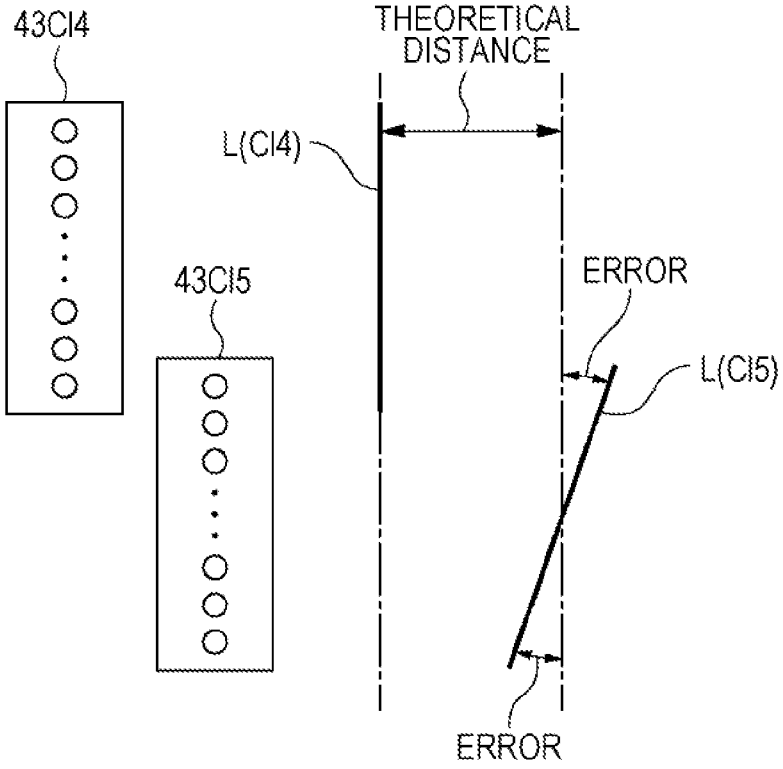
FIG. 10 is a second explanatory diagram of a test pattern.

FIG. 10 is a second explanatory diagram of a test pattern. In FIG. 10, two adjacent clear ink heads 43Cl4 and 43Cl5 are illustrated. Further, in FIG. 10, ruled lines having been printed by these clear ink heads 43Cl4 and 43Cl5 are illustrated. In addition, when a test pattern is formed, the yellow ink Y is fed to the clear ink heads 43Cl4 and 43Cl5, and thus, these ruled lines become visible in yellow.

The ruled lines corresponding to these adjacent heads are printed so as to be distanced from each other by a given theoretical distance in the transportation direction. In FIG. 10, a theoretical position indication line corresponding to the ruled line L (Cl5) having been printed by the clear ink head 43Cl5, the theoretical position indication line being distanced from the ruled line L (Cl4) having been printed by the adjacent clear ink head 43Cl4 by a theoretical distance, is denoted by an alternate long and short dash line. Originally, the ruled line L (Cl5) is a line to be formed on the theoretical position indication line denoted by the alternate long and short dash line. Thus, an amount of a misalignment of the ruled line L (Cl5) relative the theoretical position indication line denoted by the alternate long and short dash line corresponds to an error.

Here, an amount of a misalignment of the ruled line L (Cl5) is obtained by making the ruled line L (Cy4) a baseline, and on the basis of this obtained amount of a misalignment, a compensation value by which landing positions of dots formed by the clear ink head 43CL5 are to be corrected is obtained.

As described above, in FIG. 10, a theoretical position indication line is denoted by an alternate long and short dash line, and obtaining an error relative to this alternate long and short dash line is common to the foregoing case of FIG. 8. For this reason, in the case of FIG. 10, as a result, it becomes possible to obtain a compensation value in the same method as that for obtaining a compensation value, having been described by using FIG. 9. Accordingly, the method for obtaining a compensation value is omitted here.

Further, the method for calculating the misalignment amount x, having been described by using FIGS. 8 to 10, can be applied to ruled lines L (W) having been printed by the white ink heads 43W in the same way as described above. That is, a compensation value by which landing positions of dots formed by a white ink head 43W4 are to be corrected can be obtained by obtaining an amount of a misalignment of a ruled line L (W4) having been printed by the white ink head 43W4 while making a ruled line L (Cy4) having been printed by the cyan ink head 43Cy4 a baseline. Further, with respect to the white ink head 43W4 and a white ink head 43W5 which are adjacent to each other, an amount of a misalignment of a ruled line L (W5) is obtained by making the ruled line L (W4) a baseline, and this obtained amount of a misalignment of the ruled line L (W5) makes it possible to obtain a compensation value by which landing positions of dots formed by the white ink head 43W5 are to be corrected.

The compensation values having been obtained in such a way as described above are stored in the memory 13 of the printer 1 (S108). Further, as a result, when printing is carried out, relevant dot formation positions are corrected by using the stored compensation values.

Figure 11:
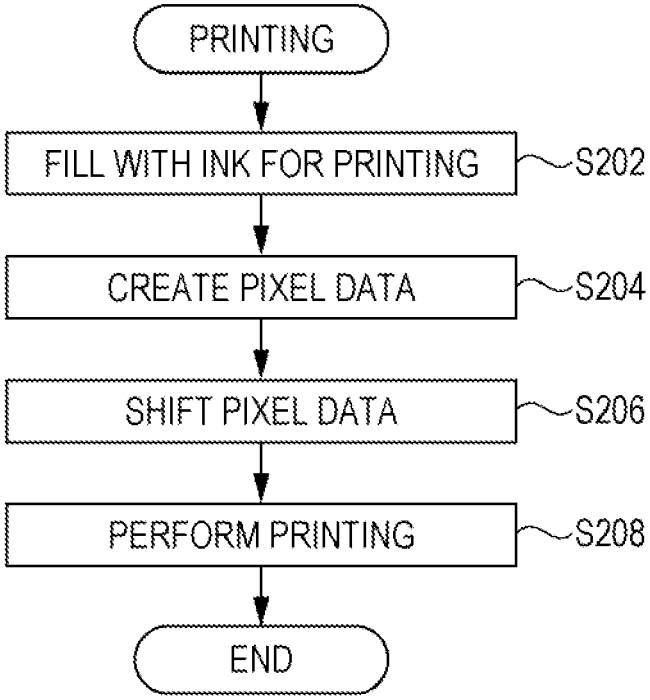
FIG. 11 is a flowchart illustrating printing processing.

FIG. 11 is a flowchart illustrating printing processing. In the case where a test pattern has been printed immediately before beginning of printing processing, each of the clear ink heads 43Cl must be filled with the yellow ink Y and each of the white ink heads 43W must be filled with the cyan ink Cy. Meanwhile, before actually performing printing of images, each of the heads needs to be filled with a corresponding one of the inks for use in printing. Thus, filling the heads 43 included in each of the head units 41 with a corresponding ink for printing is performed (S202).

In addition, in the case where this printing processing has been performed immediately before beginning of printing processing and each of the heads 43 is already filled with a corresponding ink for printing, the processing in step S202 can be omitted.

Next, pixel data is created (S204). This creation of pixel data can be carried out by utilizing a printer driver installed in the computer 100. The pixel data is data which specifies, for each of pixels on a medium, an ink color and a dot size of an ink to be landed. Thus, the printer driver creates the pixel data by obtaining, for each of pixels on a medium, the ink color and the dot size of an ink to be landed, on the basis of image data given by an application.

Next, pixel data shifting processing is performed (S206).

Figure 12:
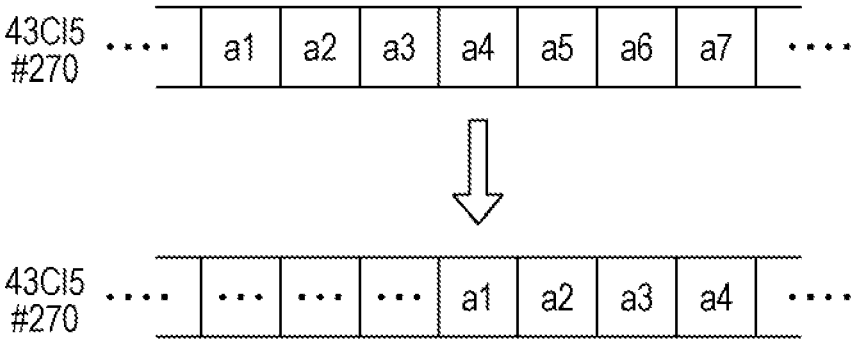
FIG. 12 is an explanatory diagram of pixel data shifting processing.

FIG. 12 is an explanatory diagram of pixel data shifting processing. This pixel data shifting processing is processing for interchanging pixel data so as to cause the positions of relevant pieces of pixel data to be shifted, on the basis of obtained compensation values. In the upper portion of FIG. 12, pixel data before beginning of image data shifting processing is illustrated, and in the lower portion of FIG. 12, pixel data after completion of pixel data shifting processing is illustrated.

Pixels on the paper S form rows of pixels aligning in the direction in which the paper S is transported. One of the rows of pixels corresponds to, for each of the head units, one of the nozzles included in one of the heads. In the upper portion of FIG. 12, as an example, a row of pixels, corresponding to a nozzle #270 of the clear ink head 43Cl5, is illustrated. Each of variables a1 to a7, which are illustrated so as to be associated with their respective corresponding pixels, includes an ink color and a dot size of a dot to be formed on its corresponding pixel.

For example, it is supposed that the foregoing misalignment amount x corresponding to the nozzle #270 of the clear ink head 43Cl5 is 0.25 millimeters. In this embodiment, the size of a pixel is 0.071 millimeters, and thus, it can be understood that three pieces of pixel data whose number is obtained by approximately dividing "0.25" by "0.071" need to be shifted. That is, a value "3" representing three pixels is stored as a compensation value corresponding to the nozzle #270 of the clear ink head 43Cl5. According to FIG. 9 described above, it can be understood that shifting of pixel data to the positive side in an X direction results in forming corresponding dots at their respective correct positions. Thus, as shown in the lower portion of FIG. 12, the pixel data is reconfigured such that the individual pieces of pixel data are shifted to the right-hand side by three pixels (S206).

After the shifting processing on pieces of pixel data with respect to nozzles corresponding to each of all the pixels has been completed in the same way as described above, printing is carried out on the basis of resultant corrected pixel data (S208). In this way, each of dots can be formed on a corresponding corrected position.

According to this embodiment, when forming a test pattern, a colored ink is fed to each of clear ink heads which ejects a clear ink, and thus, each of the clear ink heads can form a corresponding colored ruled line. Further, visible ruled lines can be formed, and thus, through these visible ruled lines, it is possible to appropriately obtain compensation values for corrections of landing positions. Further, it is possible to perform printing on the basis of these obtained compensation values.

In addition, in this embodiment, the number of pixels to be shifted is handled as a compensation value, but in the case where ejection timing is adjusted in the correction of a landing position of an ink, an amount of shifting of ejection timing may be handled as the compensation value.

Further, a correction method for ink landing positions is not limited to the aforementioned method. If a correction method for ink landing positions includes processing for, when forming a test pattern, forming a colored pattern by feeding a colored ink to clear ink heads each for ejecting a clear ink, and obtaining compensation values on the basis of this colored pattern, this correction method is included in the scope of this embodiment.

Other Embodiments

In the aforementioned embodiment, the description has been made on the printer 1, but the invention is not limited to this and can be also embodied in liquid ejection apparatuses each injecting or ejecting a fluid material other than ink, such as a liquid, a liquid material in which particles of functional materials are dispersed, or a fluid material such as a gel material. The same technologies as those of the aforementioned embodiment may be applied to various devices to which ink jet technologies are applied, such as color filter manufacturing devices, dyeing devices, micro fabrication devices, semiconductor manufacturing devices, surface treatment devices, three-dimensional modeling devices, gas evaporation devices, organic EL manufacturing devices (particularly, polymer EL manufacturing devices), display manufacturing devices, coating devices, and DNA chip manufacturing devices. Further, not only the devices themselves but also methods for realizing target services provided by the devices and manufacturing methods for target products of the devises are also included within the scope of the application of the invention.

The aforementioned embodiments are intended to make it easy to understand the invention and are not intended to limit the interpretation of the invention. The invention may be modified and improved without departing from the spirit of the invention, and obviously, equivalents thereof are included in the scope of the invention.

Regarding Heads

In the aforementioned embodiment, inks are ejected by using piezoelectric elements. However, methods of ejecting liquids are not limited to this method. Other methods, such as a method of generating bubbles inside a nozzle by means of heating, may be employed.

The entire disclosure of Japanese Patent Application No. 2013-071619, filed Mar. 29, 2013 is expressly incorporated by reference herein.

What is claimed is:

1. A method for calculating a compensation value for use in a correction of a liquid landing position in a liquid ejection device provided with a first head for ejecting a first colored liquid onto a medium from a first nozzle and a second head for ejecting a transparent liquid onto the medium from a second nozzle, the method comprising:

when forming a test pattern on a medium, forming the test pattern by feeding the first colored liquid to the second head and causing the second head to eject the first colored liquid from the second nozzle, and obtaining a compensation value for a correction of a landing position of a liquid ejected by the second nozzle on the basis of the test pattern formed on the medium.

2. The method for calculating a compensation value, according to claim 1, wherein the liquid ejection device is provided with a third head for ejecting a white liquid, and wherein, when the test pattern is formed, the test pattern is formed by feeding a second colored liquid to the third head and causing the third head to eject the second colored liquid, and a compensation value for a correction of a landing position of a liquid ejected by the third head is obtained on the basis of the test pattern formed on the medium.

3. The method for calculating a compensation value, according to claim 2, wherein, when the test pattern is formed, a color of the first colored liquid fed to the second head is different from a color of the second colored liquid fed to the third head.

4. The method for calculating a compensation value, according to claim 1, wherein the liquid ejection device is provided with a first container for storing therein the first colored liquid and a first flow path for feeding the first colored liquid to the second head from the first container and a second container for storing therein the transparent liquid and a second flow path for feeding the transparent liquid to the second head from the second container, and wherein, when the first colored liquid is fed to the second head, the first colored liquid is fed to the second head through the first flow path, and feeding of the transparent liquid to the second head through the second flow path is brought to a stop.

5. The method for calculating a compensation value, according to claim 1, wherein the liquid ejection device is provided with a fourth head for ejecting a colored liquid whose color is different from a color of the first colored liquid, and wherein, when the test pattern is formed, the fourth head is caused to form a first pattern, the second head is caused to form a second pattern, and a compensation value for a correction of a landing position of a liquid ejected by the second head is obtained on the basis of the first pattern and the second pattern.

6. The method for calculating a compensation value, according to claim 1, wherein the liquid ejection device is provided with a plurality of second heads;

wherein the plurality of second heads are arranged such that a nozzle row of any one of the second heads extends so as to overlap at least part of a nozzle row of at least one of the other second heads in a direction intersecting with a direction in which the medium is transported, and wherein a compensation value for a correction of a landing position of a liquid ejected by any one of the second heads is equivalent to a compensation value which is obtained such that, for any two of the second heads, a landing position of a liquid ejected by one of the two second heads is made a baseline, and on the basis of the baseline, a compensation value for a correction of a landing position of a liquid ejected by the other one of the two of the second heads is obtained.

7. The method for calculating a compensation value, according to claim 1, wherein the test pattern is read in by an image reader, and a compensation value for a correction of a liquid ejected by the second head is obtained on the basis of the image data which is read in by the image reader.

8. The method for calculating a compensation value, according to claim 1, wherein the compensation value corresponds to a compensation value for a correction of a formation position of a dot which, on the medium, needs to be formed at a position coinciding with a position of a target pixel.

* * * * *